United States Patent [19]

Erckel et al.

[11] Patent Number: 4,556,431

[45] Date of Patent: Dec. 3, 1985

[54] PROCESS FOR HYDROLYZING CELLULOSE-CONTAINING MATERIAL WITH GASEOUS HYDROGEN FLUORIDE

[75] Inventors: Rüdiger Erckel, Eppstein; Raimund Franz, Kelkheim; Rolf Woernle, Bad Soden am Taunus; Theodor Riehm, Heidelberg, all of Fed. Rep. of Germany

[73] Assignee: Hoechst Aktiengesellschaft, Fed. Rep. of Germany

[21] Appl. No.: 706,919

[22] Filed: Feb. 28, 1985

Related U.S. Application Data

[63] Continuation of Ser. No. 434,587, Oct. 15, 1982, abandoned.

[30] Foreign Application Priority Data

Oct. 24, 1981 [DE] Fed. Rep. of Germany ..... 3142214

[51] Int. Cl.[4] ..... C13K 1/02

[52] U.S. Cl. ..... 127/37; 162/14; 162/63

[58] Field of Search ..... 162/19, 47, 63, 66, 162/67, 88, 89, 34, 35, 42, 248, 249, 241, 14, 15, 16; 137/2, 37

[56] References Cited

U.S. PATENT DOCUMENTS

| | | | |
|---|---|---|---|
| 3,481,827 | 12/1969 | Brooks | 162/63 |
| 3,619,350 | 7/1969 | Marchfelder | 162/67 |
| 3,919,041 | 11/1975 | Wilder | 162/89 |

FOREIGN PATENT DOCUMENTS

| | | |
|---|---|---|
| 0051237 | 10/1981 | European Pat. Off. . |
| 606009 | 1/1933 | Fed. Rep. of Germany . |
| 585318 | 9/1933 | Fed. Rep. of Germany . |
| 577764 | 6/1981 | Fed. Rep. of Germany . |

OTHER PUBLICATIONS

Seike et al., Industrial and Engineering Chem. Prod. Res. Dev. 21:11-16, (1982).

Chemical Abstracts 96:202455v (1982).

Hardt et al., in *Biotechnology and Bioengineering*, John Wiley & Sons, N.Y., 1982, pp. 903-918.

Kirk-Othmer Encyclopedia of Chemical Technology, 2nd Ed., vol. 22, Wiley-Interscience, 1970, pp. 383-384; 3rd Ed., vol. 4, 1978, p. 547; vol. 11, 1980, pp. 348-349, 362-363.

The Condensed Chemical Dictionary, 6th Ed., Reinhold, N.Y., 1961, p. 590.

Concise Chemical & Technical Dictionary, Chem. Pub. Co., 1974, p. 558.

Fredenhagen et al., "Breakdown of Cellulose by Hydrogen Fluoride . . . ", Angewandte Chemie, Feb. 1933, vol. 46, 7, pp. 113-124.

*Primary Examiner*—Steve Alvo

*Attorney, Agent, or Firm*—Connolly and Hutz

[57] ABSTRACT

A continuous process for hydrolyzing cellulose-containing material (substrate) with gaseous hydrogen fluoride, HF is sorbed by the substrate at a temperature above its boiling point in n sorption steps and thereafter the sorbed HF is removed from the substrate by heating in n desorption steps. The number n of sorption steps and of desorption steps is identical and the reaction steps mentioned each occur in reactors which are separated from one another in a gas-tight manner. After introduction into the first sorption reactor (1*a*), the substrate passes consecutively through gas-tight valves into the second (1*a*) . . . nth sorption reactor and from the latter, optionally via a hold-up reactor (2) into the first, second, . . . nth desorption reactor (3*a*) and is removed from the nth desorption reactor (3*a*). The streams of HF gas, which contain an inert carrier gas in addition to HF, are circulated between the first (1*a*) or second (1*b*) or . . . (n-1)th or nth sorption reactor and the nth (3*a*) or (n-1)th (3*b*) . . . or second or first desorption reactor respectively.

11 Claims, 2 Drawing Figures

PROCESS FOR HYDROLYZING CELLULOSE-CONTAINING MATERIAL WITH GASEOUS HYDROGEN FLUORIDE

This application is a continuation of Ser. No. 434,587, filed Oct. 15, 1982 and now abandoned.

It is known that cellulose-containing material, for example wood or waste from annual plants, can be chemically digested with mineral acids. During this, the cellulose contained therein, which is a macromolecular material, is decomposed, with cleavage of glycosidic bonds, into smaller, water-soluble molecules, as far as the monomer units, the glucose molecules. The sugars thus obtained can, inter alia, be fermented to produce alcohol or used as a raw material for fermentation to produce proteins. This gives rise to the industrial importance of the hydrolysis of wood. Mineral acids which are suitable for this purpose and which were already employed on a large scale decades ago are dilute sulfuric acid (Scholler process) and concentrated hydrochloric acid (Bergius process); in this context, see, for example, Ullmanns Encyklopädie der technischen Chemie (Ullmann's Encyclopedia of Industrial Chemistry), 3rd edition, Munich-Berlin, 1957, volume 8, pages 591 et seq.

It is also known that hydrogen fluoride can be used for the hydrolysis of wood. Its boiling point (19.7° C.) makes it possible to bring it into contact with the substrate to be digested without water as a solvent and to recover it after digestion is complete with comparatively little expense. In this instance, suitable substrates for digestion are not only untreated material, on the contrary, it has also already been suggested that waste paper or lignocellulose, which is the residue from preliminary hydrolysis, should be used instead, and this still contains only very little hemicelluloses and other accompanying substances from wood and is composed almost exclusively of cellulose and lignin. Not only wood but also paper or residues of annual plants of all types, such as straw or bagasse, can be subjected to this preliminary hydrolysis. According to the state of the art, it comprises exposure to water or dilute mineral acid (about 0.5% strength) at 130° to 150° C. (cf. for example the handbook "Die Hefen" ("Yeasts") volume II, Nuremberg, 1962, pages 114 et seq.) or to saturated steam at 160° to 230° C. (cf. U.S. Pat. No. 4,160,695).

For the reaction of hydrogen fluoride with cellulose-containing material, three industrial process principles are known from the literature: reaction with gaseous hydrogen fluoride under atmospheric pressure, extraction with liquid hydrogen fluoride, and finally reaction with gaseous hydrogen fluoride in vacuo.

In German Pat. No. 585,318, a process and a device for treating wood with gaseous hydrogen fluoride are described in which, in a first zone of a reaction tube having a conveying screw, hydrogen fluoride gas, which can be diluted with an inert gas, is brought to reaction with wood by this zone being cooled from outside to below the boiling point of hydrogen fluoride. After digestion, which can optionally take place in an intermediate zone, according to this process the hydrogen fluoride is driven off by external heating and/or blowing out with a stream of inert gas, in order to be brought into contact again with fresh wood in the cool zone mentioned.

In practice, however, carrying out this process is difficult. When the hydrogen fluoride condenses on the substrate, it only distributes non-uniformly, so that overheating occurs in places. This is clear, for example, from German Pat. No. 606,009, in which is stated: "It has emerged that on merely moistening the polysaccharides, for example the wood, with hydrofluoric acid or on charging the wood and the like with hydrofluoric acid vapors, increases in temperature can occur which lead to partial decomposition of the conversion products formed. However, removal of this heat by cooling is difficult due to the poor thermal conductivity of the cellulose-containing material." The remedy described in this patent is extraction with liquid hydrogen fluoride, but this requires large amounts of hydrogen fluoride and is associated with the disadvantage that, in order to vaporize the hydrogen fluoride from the extract and from the extraction residue (lignin), large amounts of heat must be supplied and these must be removed again during the subsequent condensation.

Austrian Pat. No. 147,494, which was published a few years later, analyzes the two processes mentioned. The remedy described in this patent to counteract the non-uniform and incomplete degradation of the wood on digestion with highly concentrated or anhydrous hydrofluoric acid in the liquid or gaseous state at low temperatures, and to counteract the disadvantages of the high excess of hydrofluoric acid in the extraction process is an industrially elaborate process in which the wood is evacuated as far as possible before exposure to hydrogen fluoride and the recovery of the hydrogen fluoride is also carried out in vacuo. The process is also described in the journal "Holz, Roh- und Werkstoff" 1 (1938) 342–344. The high industrial cost of this process is not only due to the vacuum techniques themselves, but also due to the circumstance that the boiling point of hydrogen fluoride is already less than −20° C. at 150 mbar; this means that, without the assistance of expensive coolants or cooling units, condensation is no longer possible.

The state of the art of digesting wood with hydrogen fluoride known from the literature is characterized by the three processes or devices described. Accordingly, none of these methods or devices combines low cost and good results of digestion in a manner which is industrially satisfactory. The method of reacting, which is in itself economical, cellulose-containing material with a mixture of hydrogen fluoride and an inert gas, which originates from hydrogen fluoride desorption, according to German Pat. No. 585,318, which has already been mentioned above, is, according to the more recently published German Pat. No. 606,009, apparently adversely affected by the necessity of cooling below the boiling point of hydrogen fluoride during the absorption.

Surprisingly, it has now been found that gaseous hydrogen fluoride mixed with an inert carrier gas can be recycled almost without loss while producing a concentration on the substrate which is necessary for good yields, without it being necessary in this process to cool below the boiling point of hydrogen fluoride, which is highly disadvantageous industrially. This is achieved by dividing the sorption and desorption processes into several steps which, according to the HF concentration on the substrate which differs in each case, use streams of gas mixtures of different concentrations, so that it is possible during sorption, to allow gas mixtures which are low in HF to act on material which has a low or zero concentration and to allow mixtures having higher HF concentrations to act on material which already has a higher concentration.

This measure was not obvious. On the contrary, statements in the literature lead to the conclusion that an adequate concentration on wood material is not possible above the boiling point of hydrogen fluoride, even when the latter is undiluted. In a report by Fredenhagen und Cadenbach, Angew. Chem. 46 (1933) 113/7, they say (page 115 bottom right-hand side to page 116 top left-hand side): "When gaseous HF is allowed to act on wood at room temperature, HF is absorbed and, as a result, the temperature rises. However, this means that no more HF is absorbed, so that the reaction comes to a standstill and no further increase in temperature occurs." Thus it was all the more surprising to find that hydrogen fluoride sorption is largely independent of the heat of reaction, which only makes itself noticeable up to relatively low concentrations, and, at a given temperature, the sorption only depends on the HF concentration in the gas mixture acting, i.e. it can also be carried out at temperatures above the boiling point of hydrogen fluoride up to the concentration levels necessary for good yields by stepwise production and use of streams having different HF concentrations.

Thus, the invention relates to a continuous process for digesting cellulose-containing material (substrate) with gaseous hydrogen fluoride by sorption of the HF and subsequent desorption, which comprises the sorption of the HF by the substrate being carried out at a temperature above its boiling point in n sorption steps, and thereafter the substrate being freed of the sorbed HF by heating in n desorption steps, the number n of sorption steps and of desorption steps being the same, and the steps mentioned each being carried out in reactors separated from one another in a gas-tight manner, and the substrate, after introduction into the first sorption reactor, consecutively reaching, through gas-tight valves, the second, . . . nth sorption reactor and from the latter reaching the first, second, . . . nth desorption reactor and being removed from the last (nth) desorption reactor, and there being separate circulations of the streams of HF gas, which contain an inert carrier gas in addition to HF, between the first or second or . . . or nth sorption reactor and the nth or . . . or second or first desorption reactor respectively.

In the process according to the invention, the sorption of the HF and the desorption are each preferably carried out in 2 to 6, in particular 2 to 4, steps in the corresponding number (in each case, 2 to 6, in particular 2 to 4) of reactors (n=preferably 2 to 6, in particular 2 to 4).

The reactors, which are separated from one another by gas-tight valves, can be of identical or different types; examples of suitable reactors are stirred vessels, rotating cylinders, fluidized driers, moving beds, screw conveyors, vertical countercurrent or fluidized bed reactors. They can optionally be provided with a device for heating or cooling.

The cellulose-containing material which can be employed is wood or waste from annual plants (for example straw or bagasse) or, preferably, a preliminary hydrolyzate of wood or waste from annual plants, or, equally preferably, waste paper.

It is known that the presence of a certain amount of water is necessary for the digestion of celluloses, which is, of course, a hydrolytic cleavage. This water can either be introduced by being present in the substrate as residual moisture of 0.5 to 20, preferably 1 to 10, in particular 3 to 7, % by weight or by being contained in the mixture of HF and inert gas, or in both.

Transport of the reactant (substrate), the cellulose-containing material, from one reactor to another is carried out, for example, by falling free, via rotary vane valves and/or by conveying screws.

Suitable inert carrier gases are air, nitrogen, carbon dioxide or one of the inert gases, preferably air or nitrogen.

According to the invention, the path of the gas is such that, in each case, one sorption and one desorption reactor form a reactor pair connected with one another by gas pipes. A gas outlet of the first sorption reactor is connected with a gas inlet of the last (nth) desorption reactor and a gas outlet of this last desorption reactor is connected with a gas inlet of the first sorption reactor via gas pipes to form a (first) reactor system. A gas pump or a blower and a heat-exchanger are also interpolated upstream of the gas inlet of the desorption reactor.

Correspondingly, the second sorption reactor is connected with the penultimate ((n−1)th) desorption reactor to form a second reactor system . . . and finally the last (nth) sorption reactor is connected with the first desorption reactor to form the nth reactor system.

Heat-exchangers can also optionally be arranged upstream of the gas inlet of the sorption reactors. They each have the task, if necessary, of bringing the gas mixture intended for sorption to the optimum temperature for this purpose. Under certain circumstances, they have the additional task of condensing out any accompanying substances of the inlet material which have been liberated during desorption, such as water, acetic acid or ethereal oils, but of allowing the hydrogen fluoride to pass in the form of a gas.

In each reactor system, an HF-carrier gas stream is circulated through the particular gas pump. In the sorption reactor, the gas mixture loses HF and in the heat-exchanger it is heated to the temperature necessary for desorption. In the desorption reactor, the gas mixture is enriched with HF by the HF given off during desorption and is again passed to the sorption reactor.

The HF concentration in the HF-carrier gas stream in the first reactor system is relatively low before entering the sorption reactor. In the first sorption reactor, it acts on the substrate, which as yet has no concentration of HF. In the second and in the following reactor systems, the HF concentration in the HF-carrier gas stream must be higher, since the substrate to be treated in the particular sorption reactor has an increasingly high concentration of HF.

The maximum concentration of HF on the cellulose-containing material in the last sorption step depends on its nature and characteristics and on the dwell time in the sorption steps and thus is between 10 and 120, preferably between 30 and 80, % relative to the weight of the material employed.

If appropriate, the substrate having a high concentration of HF can, after leaving the last sorption reactor and before entering the first desorption reactor, can also pass through a hold-up reactor, the temperature of which is advantageously maintained in the range between that of the last sorption reactor and that of the first desorption reactor, and which is optionally provided with a device for crushing coarse reactant.

After sorption, the HF concentration in the gas stream leaving the first sorption reactor is approximately 0% by weight, and is up to about 80% by weight at the nth sorption reactor. After desorption, the HF concentration in the gas stream leaving the first desorption reactor is up to more than 95% by weight.

The optimum dwell-time, i.e. the average duration of stay of the substrate in the apparatus from the start of sorption to the end of desorption, depends on the nature and characteristics of the material to be digested and must be adjusted to suit the particular case. Accordingly, it can be within the range from about 30 minutes up to about 5 hours.

The substrate temperatures selected for desorption are in the range from 40° to 120° C., preferably from 50° to 90° C., it being possible for the temperatures for the individual steps to be different, whilst the temperature selected for the relevant sorption in each case is in the range from 20° to 50° C., preferably 30° to 45° C.

In contrast to the normal countercurrent principle according to the state of the art, the arrangement according to the invention permits the rate of flow and temperature of the HF-carrier gas mixture to be adjusted to suit the requirements of the particular reactor systems, which are each different and depend on the concentration of HF on the substrate.

The invention is to be illustrated in more detail using FIGS. 1 and 2.

Figure 1:
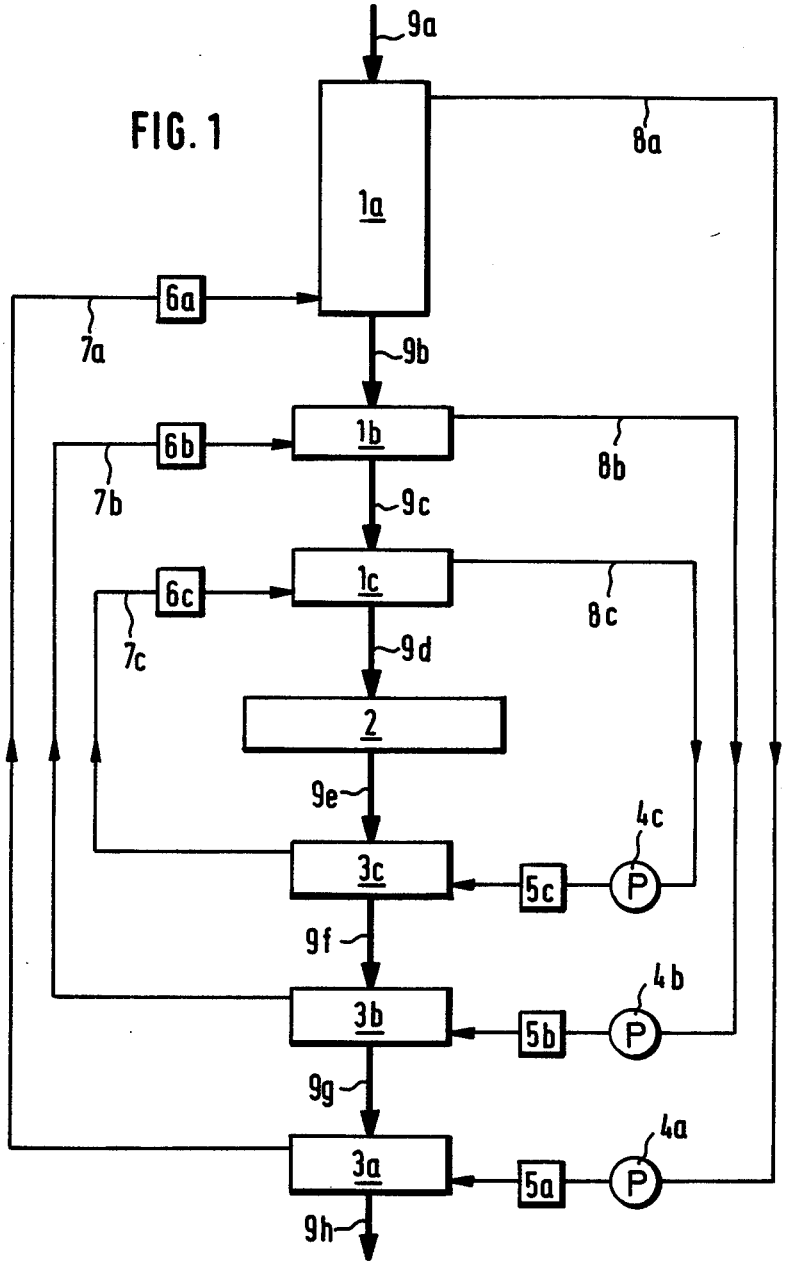
FIG. 1 represents the flow diagram of the course of a reaction according to the invention in 3 sorption and 3 desorption reactors.

In these figures, the numbers given represent the following:

| | |
|---|---|
| 1a, b, c | sorption reactors |
| 2 | hold-up reactor |
| 3a, b, c | desorption reactors |
| 4a, b, c | gas pumps (blowers) |
| 5a, b, c | heat-exchangers |
| 6a, b, c | heat-exchangers |
| 7a, b, c | gas pipes from the desorption reactors 3a, b, c to the sorption reactors 1a, b, c |
| 8a, b, c | gas pipes from the sorption reactors 1a, b, c to the gas pumps 4a, b, c |
| ga–h | these arrows symbolize the flow of material |
| 10 | three-way tap (three-way valve) |
| 11 | gas pipe from reactor 3c to the three-way valve 10 |

The sorption reactor 1*a* is connected via the gas pipe 8*a*, the pump 4*a* and the heat-exchanger 5*a* to the desorption reactor 3*a* and this is connected via the gas pipe 7*a* and the heat-exchanger 6*a* with the sorption reactor 1*a*. An HF-inert gas mixture having a relatively low HF concentration flows in this first system. Analogously, the sorption reactors 1*b* and 1*c* respectively are connected via the gas pipes 8*b* and 8*c*, the pumps 4*b* and 4*c* and the heat-exchangers 5*b* and 5*c* to the desorption reactors 3*b* and 3*c* respectively, and these are connected via the gas pipes 7*b* and 7*c* and the heat-exchangers 6*b* and 6*c* to the sorption reactors 1*b* and 1*c* respectively to form a second and third system respectively.

HF-inert gas mixtures again flow in these second and third systems. The HF concentration in the second system is higher than in the first system but lower than in the third system.

The cellulose-containing material (substrate) to be digested is introduced into sorption reactor 1*a*. In FIG. 1, this process is symbolized by arrow 9*a*. HF is sorbed by the substrate from the HF-inert gas mixture entering reactor 1*a*. The substrate is transported to sorption reactor 1*b* through a gas-tight valve (arrow 9*b*), where it sorbs further HF from the HF-inert gas mixture flowing in the second system and finally is transported to the sorption reactor 1*c* (arrow 9*c*), where it reaches its maximum HF concentration by sorption of further HF.

From the third and last sorption reactor 1*c*, the substrate having a high concentration of HF is transported to the hold-up reactor 2 (arrow 9*d*) and from there it is transported to the first desorption reactor 3*c* (arrow 9*e*). The HF-inert gas mixture leaving sorption reactor 1*c* which is low in HF enters desorption reactor 3*c* after passing through gas pipe 8*c* and pump 4*c* and heating in the heat-exchanger 5*c*.

Desorption occurs in desorption reactor 3*c* due to the heated HF-inert gas mixture low in HF being passed over the substrate having a high concentration of HF, HF being given off from the substrate to the HF-inert gas mixture and this is thereby again enriched with HF.

The substrate is transported from reactor 3*c* to desorption reactors 3*b* and 3*a* (arrows 9*f* and 9*g*), in which further desorption of HF, in analogy to reactor 3*c*, occurs due to the heated HF-inert gas mixtures, which are low in HF and have passed through the gas pipes 8*b* or 8*a* and the pumps 4*b* or 4*a* and have been heated in the heat-exchangers 5*b* or 5*a* and have entered the desorption reactors 3*b* or 3*a*, being passed over. These mixtures are again enriched with HF by desorption of the HF given off by the substrate.

After completion of desorption in reactor 3*a*, the substrate leaves it in a digested form (arrow 9*h*). It only contains traces of residual hydrogen fluoride and is passed on for working up, which is carried out in a manner known per se.

Figure 2:
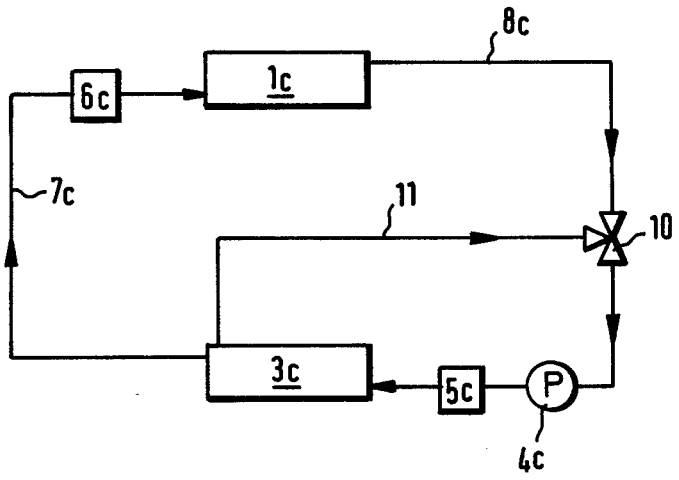
FIG. 2 represents a detail of the overall flow diagram with subdivision of the gas circulation on the desorption side.

A particular embodiment is shown schematically in FIG. 2. In the third system with reactors 1*c* and 3*c*, the three-way valve 10 is inserted into the gas pipe upstream of pump 4*c*. This makes it possible to return one (more or less large) part of the HF-inert gas stream after passing the substrate in the desorption reactor 3*c* back to pump 4*c*, in a special circuit via the gas pipe 11. The three-way valve 10 can also be a control valve. The part of the HF-inert gas mixture which is returned in this special circuit is about 10 to about 90%, preferably about 50 to about 90%, of the total mixture leaving desorption reactor 3*c*. Obviously, the three-way valve 10 can be replaced by a T piece and a (control) valve can be inserted into gas pipe 11.

This particular arrangement, which in the other systems analogously makes possible a partial return of the HF-inert gas mixtures leaving the desorption reactors 3*a* and 3*b* into the other systems, makes it possible to optimize the gas flow rates of the circulating HF-inert gas mixtures.

The material prepared by digestion in the process according to the invention is a mixture of lignin and oligomeric saccharides. It can be worked up in a manner known per se by extraction with water, advantageously at an elevated temperature or at the boiling point, with simultaneous or subsequent neutralization, for example with lime. Filtration provides lignin which, for example, can be used as a fuel, as well as a small amount of calcium fluoride which originates from the residual hydrogen fluoride present in the material from the reaction. The filtrate, which is a clear pale yellowish saccharide solution, can either be passed directly, or after adjustment to an advantageous concentration, for alcoholic fermentation or enzyme action. The dissolved oligomeric saccharides can also be converted almost quantitatively to glucose by a brief after-treatment, for example with very dilute mineral acid at temperatures above 100° C.

EXAMPLES

These were carried out with an arrangement of the equipment as is shown schematically in FIG. 1, that is to say with three HF-inert gas mixture circuits a, b and c.

EXAMPLE 1

(a) A hydrogen fluoride-nitrogen mixture having an HF content of about 5% by weight was introduced from below into a vertical cylindrical container (sorption reactor 1*a*) having a diameter of 50 cm and a height of 200 cm, composed of polyethylene, which was filled with granulated lignocellulose, that is to say the residue from a preliminary hydrolysis of spruce wood, the lignocellulose having a water content of about 3% by weight (substrate). The substrate was continuously removed from the bottom of the container, by means of a rotary vane, after it exhibited a concentration (in the vicinity of the bottom of the container) of 5 parts by weight of HF per 100 parts by weight of substrate employed. The amount of substrate removed was replaced by fresh substrate through the lid of the container by means of a rotary vane (400 g per hour). Nitrogen, which was almost free of HF, was obtained at the gas outlet point at the upper end of the cylinder, and this was passed through a gas pipe (8*a*) and a blower (4*a*) to a heat-exchanger (5*a*). It was heated to about 90° C. in the latter and introduced into a rotating cylinder reactor composed of stainless steel (desorption reactor 3*a*), in which the substrate, which had already been digested by HF and removed from the desorption reactor 3*b* and introduced into the reactor 3*a* by means of a rotary vane and which still contained about 5 parts by weight of HF per 100 parts by weight of substrate, was passed in the opposite direction. The temperature during this process was about 90° C. The material throughput and the gas flow rate were adjusted during this so that the substrate having about 0.5% by weight of residual HF left the desorption reactor by means of a rotary vane and the HF-nitrogen mixture having an HF content of about 5% by weight left the desorption reactor. The gas mixture was passed through a gas pipe (7*a*) to a heat-exchanger (6*a*) in which it was cooled down to about 25° C. Before entry into the heat-exchanger 6*a*, the small amount of HF, which had remained in the digested substrate which had been removed, was also metered in. The HF-nitrogen mixture, which had been enriched with HF and cooled down to 25° C., was introduced into reactor 1*a* and so on (see above).

The digested substrate was extracted in a customary manner with hot water, and the solution was neutralized with calcium hydroxide, filtered and evaporated. Wood sugar was thus obtained in a yield of 85%, relative to the cellulose contained in the substrate employed (about 60% by weight).

(b) An HF-nitrogen mixture having an HF content of about 25% by weight was passed in the opposite direction to the substrate in a rotating cylinder reactor composed of stainless steel (sorption reactor 1*b*), which was continuously charged by means of a rotary vane with a substrate removed from sorption reactor 1*a*, which had a certain concentration of HF (about 5 parts by weight of HF per 100 parts by weight of substrate), and was filled to about 50% of its volume. The substrate temperature during this was about 40° C. On leaving reactor 1*b*, the gas mixture had an HF content of about 10% by weight. The substrate was removed by means of a rotary vane. It had a content of about 30 parts by weight of HF per 100 parts by weight of substrate employed. The gas mixture leaving the reactor was passed through a gas pipe (8*b*) and a pump (4*b*) to a heat-exchanger (5*b*) and thereafter to a rotating cylinder reactor composed of stainless steel (desorption reactor 3*b*) which was provided with an electrical heating mantle. The heating of the gas mixture in the heat-exchanger 5*b* and the heating mantle were adjusted with respect to one another such that a substrate temperature of about 70° C. was maintained in desorption reactor 3*b*. The desorption reactor 3*b* was charged by means of a rotary vane with substrate which was removed from the desorption reactor 3*c* and had an HF content of about 30 parts by weight of HF per 100 parts by weight of substrate. The substrate leaving reactor 3*b* had an HF content of about 5 parts by weight per 100 parts by weight of substrate and was passed to desorption reactor 3*a* by means of a rotary vane. The HF-nitrogen mixture leaving reactor 3*b* had an HF content of about 25% by weight. It was passed through the gas pipe 7*b* and the heat-exchanger 6*b*, in which it was cooled down to 25°–30° C., to reactor 1*b* and so on (see above).

(c) The substrate having a certain concentration of HF (about 30 parts by weight of HF per 100 parts by weight of substrate), which was removed from reactor 1*b*, was introduced continuously into a vertically arranged cylindrical reactor composed of stainless steel (sorption reactor 1*c*) having a diameter of 5 cm and a length of 50 cm, in the longitudinal axis of which was provided a slowly rotating shaft having narrow blades to prevent bridging. An HF-nitrogen mixture having an HF content of about 65% by weight was passed from below in the opposite direction to the substrate. The substrate temperature during this was about 40° C. On leaving reactor 1*c*, the gas mixture had an HF content of about 25% by weight. The substrate had reached its maximum HF concentration of 60 parts by weight of HF per 100 parts by weight of substrate and was conveyed, by means of a rotary vane, into a hold-up reactor (2), a cylindrical vessel composed of polyethylene having a heating mantle. The average dwell time in this was 30 min. and the temperature of about 50° C. was maintained by means of hot water flowing through the heating mantle. The gas mixture leaving reactor 1*c* was passed through a gas pipe (8*c*) via a three-way valve (10), a pump (4*c*), a heat-exchanger (5*c*) and then to a rotating cylinder reactor composed of stainless steel (desorption reactor 3*c*) having an electrical heating mantle. The heating of the gas mixture in heat-exchanger 5*c* and the heating mantle were adjusted with respect to one another so that a substrate temperature of about 60° C. was maintained in desorption reactor 3*c*. The reactor 3*c* was charged, by means of a rotary vane, with substrate which was removed from hold-up reactor 2. The substrate had an HF content of 55 parts by weight per 100 parts by weight of substrate. The HF loss compared to the substrate removed from sorption reactor 1*c* is explained by the temperature in hold-up reactor 2 being about 10° C. higher. The HF being liberated in the hold-up reactor was introduced via a ventilation pipe into the gas pipe 7*c* upstream of the heat-exchanger 6*c*. The substrate leaving the reactor 3*c* had an HF content of about 30 parts by weight per 100 parts by weight of substrate and was conveyed by means of a rotary vane to the desorption reactor 3b. The stream of HF-nitrogen mixture leaving reactor 3c, which had an HF content of about 65% by weight, was divided. 80% were conveyed via the three-way valve 10 to the pump 4c. 20% were conveyed through gas pipe 7c and heat-exchanger 6c, in which cooling down to about 40° C. occurred, to reactor 1c and so on (see above).

EXAMPLE 2

Untreated spruce-wood shavings, which had been dried to a residual moisture content of about 5%, were digested in accordance with the process described in detail in Example 1. During desorption in reactors 3c to 3a, materials associated with wood, such as acetic acid, were also driven out and condensed out in heat-exchangers 6c to 6a and separated off. After a customary work-up, as described in Example 1, wood sugar was obtained in a yield of about 70%, relative to the carbohydrates contained in the material employed.

We claim:

1. A continuous process for hydrolyzing cellulose-containing material to obtain hydrolytic cleavage of cellulose macromolecules and formation of smaller, water-soluble molecules, in which sorption of gaseous hydrogen fluoride occurs followed by desorption of the HF for re-use in the process, said process comprising:

sorption of the HF by the cellulose-containing material in n sorption steps carried out in n sorption zones for reaction with HF and hydrolytic cleavage of the cellulose-containing material, said n sorption steps being carried out at a temperature above the boiling point of HF; the cellulose-containing material being introduced into the first sorption zone and then consecutively passed, through gas-tight valves, into the second through nth sorption zones;

thereafter freeing the thus-digested material from the sorbed HF in n desorption steps by passing said material, through gas-tight valves, consecutively through n desorption zones, the number n of sorption steps and the number n of desorption being the same, said sorption and desorption steps each being carried out in reactors separated from each other in a gas-tight manner, except that the first sorption zone is paired with the nth desorption zone by means of a first gas circuit, through which flows gaseous HF and an inert carrier gas, gaseous HF and inert carrier gas flowing through said first gas circuit from the nth desorption zone to the first sorption zone and from the first sorption zone through said first gas circuit to the nth desorption zone; similarly, each of the second through nth sorption zones is paired with each of the (n−1)th through the first desorption zones, respectively, by a similar gas circuit, for each said pair, the HF concentration increasing in each gas circuit from the first to the nth gas circuit; and removing the thus digested and thus desorbed material from the nth desorption zone.

2. The process as claimed in claim 1, wherein the sorption of the HF and the desorption are each carried out in 2 to 6 steps.

3. The process as claimed in claim 2, wherein the sorption of the HF and the desorption are each carried out in 2 to 4 steps.

4. The process as claimed in claim 2, wherein said cellulose-containing material comprises a preliminary hydrolyzate of wood or wood waste from annual plants or waste paper.

5. The process as claimed in claim 2, wherein the inert carrier gas is air or nitrogen.

6. The process as claimed in claim 2, wherein a stream of HF gas is divided into a plurality of parts after leaving a said desorption zone and one of said parts is directly conveyed to the inlet of said desorption zone.

7. The process as claimed in claim 2, wherein several of the streams of HF gas are divided after leaving the desorption zones so that a part of each stream can be directly conveyed to the inlet of each of said desorption zones.

8. The process as claimed in claim 1, wherein said cellulose-containing material comprises a preliminary hydrolyzate of wood or wood waste from annual plants or waste paper.

9. The process as claimed in claim 1, wherein the inert carrier gas is air or nitrogen.

10. The process as claimed in claim 1, wherein a stream of HF gas is divided into a plurality of parts after leaving a said desorption zone and one of said parts is directly conveyed to the inlet of said desorption zone.

11. The process as claimed in claim 1, wherein several of the streams of HF gas are divided after leaving the desorption zones so that a part of each stream can be directly conveyed to the inlet of each of said desorption zones.

* * * * *